US005729460A

United States Patent [19]

Plett et al.

[11] Patent Number: 5,729,460

[45] Date of Patent: Mar. 17, 1998

[54] METHOD FOR PAYMENT OF THE RECREDITING OF AN ELECTRONIC POSTAGE METER AND ARRANGEMENT FOR THE OPERATION OF A DATA CENTRAL

[75] Inventors: Margaret Plett, Westmont; George G. Gelfer, Glen Ellyn; Jakob Zimmermann, Yorkville, all of Ill.; Enno Bischoff, Berlin, Germany

[73] Assignee: Francotyp-Postalia AG & Co., Birkenwerder, Germany

[21] Appl. No.: 572,615

[22] Filed: Dec. 14, 1995

[51] Int. Cl.[6] ..... G07B 17/00

[52] U.S. Cl. ..... 364/464.13; 235/375; 235/381; 340/825.35; 395/201

[58] Field of Search ..... 235/375, 380, 235/381; 340/825.3, 825.31, 825.33, 825.35; 364/464.02, 464.03, 464.11, 464.13, 464.2; 395/201

[56] References Cited

U.S. PATENT DOCUMENTS

| | | | |
|---|---|---|---|
| 3,255,439 | 6/1966 | Simjian et al. | 340/825.33 |
| 3,792,446 | 2/1974 | McFiggins et al. | 364/464.02 X |
| 4,811,234 | 3/1989 | Storace | 364/464.02 |
| 4,849,884 | 7/1989 | Axelrod et al. | 364/464.02 X |
| 5,025,386 | 6/1991 | Pusic | 364/464.02 X |
| 5,202,834 | 4/1993 | Gilham | 364/464.02 |
| 5,309,363 | 5/1994 | Graves et al. | 364/464.02 |
| 5,602,742 | 2/1997 | Solondz et al. | 364/464.2 |
| 5,606,507 | 2/1997 | Kara | 364/464.18 |
| 5,612,884 | 3/1997 | Haines | 364/464.13 |

FOREIGN PATENT DOCUMENTS

3628253 A1 2/1988 Germany .

*Primary Examiner*—Edward R. Cosimano
*Attorney, Agent, or Firm*—Hill, Steadman & Simpson

[57] ABSTRACT

In a method and apparatus for paying for recrediting of an electronic postage meter machine, switchable into a reloading mode, and communicating with a data central, data is entered into the postage meter machine and the postage meter machine is switched into a communication mode or into a credit inquiry mode. Communication is established with the data central and a plausibility check of the entered data and register values is undertaken in the data central, and a credit inquiry process is begun by the data central if a credit card number has been entered via the postage meter machine. The data central contacts a credit card processing center for verifying the credit card status of the customer and, upon receiving an authorization indicating an acceptable credit card status of the customer, the data center processes the reloading event. If the credit card processing center indicates an unacceptable credit card status, the preceding steps are repeated. A list of successful credit inquiries can be produced. The credit card processing center authorizes a transfer of funds from a bank of the customer, and subsequently the transfer of funds is implemented to credit the bank of the nationally authorized postal carrier who is responsible for postal deliveries.

17 Claims, 5 Drawing Sheets

| PIN | Date | VGW | NLW | R1 | R1a | R1b | R2 | R3 | R4 | R8 |
|---|---|---|---|---|---|---|---|---|---|---|

METHOD FOR PAYMENT OF THE RECREDITING OF AN ELECTRONIC POSTAGE METER AND ARRANGEMENT FOR THE OPERATION OF A DATA CENTRAL

BACKGROUND OF THE INVENTION

1. Field of the Invention

The present invention is directed to a method of payment for recrediting an electronic postage meter machine and to a system for operating a data central offering and producing specific services corresponding to a customer request, for users of postage meter machines by involving a commercial card company in the transaction.

2. Description of the Prior Art

A postage meter machine usually generates an imprint in a form agreed upon with the postal service, flush right, parallel to the upper edge of the postal matter, beginning with the postage value content in the postage stamp, the date in the date stamp and stamp imprints for advertising slogans and, possibly, identification of the type of mailing. The postage value, the date and the type of mailing thereby form the variable information to be entered corresponding to the particular postal item.

The postage value is usually fee (postage) prepaid by the sender that is taken from a refillable credit register and is paid to the appropriate postal authority for mailing.

With respect to the aforementioned refilling, a postal inspector reads postal register values for accounting either via a telephone link or by being physically provided with the register and subsequently makes an appropriate monetary value entry. In the known account method, another register is merely incremented dependent on the frankings undertaken with the postage value and is read by a postal inspector at regular intervals.

Each franking that is undertaken is expected to be debited and any manipulation of the machine that leads to an undebited franking must be prevented. Protection against manipulation must likewise be assured for that case wherein a remote value entry is implemented from a remote data central in order to reload the postage meter machine.

According to U.S. Pat. No. 3,255,439, it is known to undertake a reloading or recrediting of a postage meter machine by means of an automatic signal transmission from the postage meter machine to the data central whenever a predetermined sum of money that was franked is reached or whenever an item number of processed postal mailings is reached or whenever a predetermined time period is reached. Alternatively, a signal corresponding to the sum of money, number of items or time period can be communicated. The communication ensues with binary signals via converters connected to one another via a telephone line. The machine thus receives a likewise protected reloading corresponding to the credit balance and is blocked from operating if no credit is resupplied.

U.S. Pat. No. 4,811,234 discloses that the transactions be implemented encoded and that the registered data of the postage meter machine be interrogated and communicated to the data central by modem. The encoding offers the required security against manipulation of the register readings such as, for example, securing the stored, authorized remaining amount (descending register). The postage meter machine for this purpose identifies itself at the data central with an identification number and communicates its encoded register contents when a threshold, that can be set in advance, has been reached. As soon as the connection to the data central has been set up, the account of the postage meter machine user, which is kept internally in the data central, is checked in view of the validity of the account and in view of the availability of the credit requested for reloading the postage meter machine. Given an adequate available credit, the reloading is implemented with the aforementioned transaction. Otherwise, the customer service department is alerted if the credit is not available. A time reference of the reduction of the authorized remaining amount stored in the register is displayed in the data central. As warranted, the data central modifies the requested franking amount up to which franking is allowed to be carried out with appropriate authorization signals. It is also provided that the transactions be undertaken outside peak traffic times, preferably during the night, when the aforementioned, presettable threshold was reached during the course of the preceding time span. It is, however, definitely conceivable that the volume of mail to be franked fluctuates (seasonal operation) and cannot be estimated in advance. Once debited from a bank account and transferred into the postage meter machine as credit, a credit in excess of that actually needed would not draw an interest, so that the user would be more likely interested in working with smaller credit levels. In these cases, a disadvantage is that the postage meter machine often would be blocked unnecessarily when the desired credit is not available, or the user would have to communicate often with the data central because of the small recrediting amounts, even during peak traffic times. It has been proposed to maintain a user account for a franking credit in a bank, which can thus bear interest. In accord with the data communicated from the postage meter machine to the data central, the data central then inquires at the bank. In addition to account and credit data, funds are also transmitted from the bank to the data central in order to replenish the account maintained in the data central with a credit, i.e. to make the funds available that are required for a reloading of the postage meter machine. A disadvantage of this alternative method, however, is comprised therein that the customer must continue to pre-plan the next remote value entry and must consequently keep money on hand in a special user account at the bank for the reloading of the postage meter machine, this not only causing separate account management costs but also involving processing times and costs for transmitting the funds to the account maintained in the data central. Moreover, an expense would have to be incurred so that this transmission of funds into the data central would be implemented in a manner protected against manipulation.

Identification cards such as, for example, credit cards (pay later) and such as, for example, debit cards (pay now) or money cards (prepaid) are utilized worldwide for payment via plastic cards. Given current technology, however, it is complicated to make such a payment method available for standard postage meter machines which are not yet equipped with a corresponding card reading unit. Thus, a costly retrofitting action would have be implemented which is not necessary in and of itself if the previous payment system is retained.

A service output system disclosed in German OS 36 28 253 employs a money card write/read unit that is a component of an electronic memory and control means. Money cards not specifically dedicated for franking payment, such as telephone credit cards, are in fact suitable for the payment of smaller sums of money, but have not yet been approved by banks for the payment of larger amounts before the required anti-forgery security can be established.

Given payment via credit cards, for example American Express®, an identification with the credit card and a debit note method (pay later) with the involvement of an authorized credit card processing center is preferred. Such payment systems have already been proposed (U.S. Pat. No. 5,025,386) for postal processing machines and require an additional magnetic card, or a chip card write/read unit. This high outlay is only justified in the case of automatic units made accessible to the public.

SUMMARY OF THE INVENTION

An object of the present invention is to overcome the aforementioned disadvantages of the prior art and to create the technical conditions for a further payment possibility with respect to the credit reloading of postage meter machines without increasing the hardware outlay at the postage meter machine.

A further object is to provide means in the data central in order to implement a credit card method specifically associated to a postage meter machine for standard postage meter machines.

The above object is achieved in accordance with the principles of the present invention in a method and an apparatus for paying for recrediting of an electronic postage meter machine, the machine being switchable into a reloading load, and the machine communicating with a data central, wherein data is entered into the postage meter machine and the postage meter machine is switched into a communication mode or into a credit inquiry mode. Communication is established with the data central and a plausibility check of the entered data and the register values is undertaken in the data central, and a credit inquiry process is started by the data central if a credit card number has been entered via the postage meter machine. The data central contacts a credit card processing center for verifying the credit card status of the customer and, upon receiving an authorization indicating an acceptable credit card status of the customer, the data center processes the reloading sequence. If the credit card processing center indicates an unacceptable credit card status, the preceding steps are repeated a limited number of times. A list of successful credit inquiries can be produced. The credit card processing center authorizes a transfer of funds from a bank of the customer, and subsequently the transfer of funds is implemented to credit the bank of the nationally authorized postal carrier who is responsible for postal deliveries.

For the implementation of the method, an arrangement for the operation of a data central has a data bank with register entries for offering and producing specific performances corresponding to a customer request.

The data central makes memory space for subregisters available in the data bank, these subregisters being allocated to two specific accounts of the postage meter machine user. A credit from a first bank (customer bank), or from the postage meter machine user, is transferred directly into a first bank account at a specifically authorized, second bank or credit institute communicatively coupled to the data central. A credit corresponding to the prepaid amount is maintained in the specific, first subregister of the data central. A specific, second subregister in the data central is maintained for an internal reckoning of the credit. The data central is authorized by the customer to perform a corresponding service for the reloading or recrediting of his postage meter machine in order, as required, to have the money transferred in a predetermined way to the account at a third bank specifically authorized by the carrier, or onto the account at the bank of the governmental postal authority in order to pay for the service of the carrier.

When franking with a standard postage meter machine, the postage amount is deducted from the credit (remaining amount) electronically stored in the postal register (descending register). The proper authorization and reloading or crediting is checked at the side of a data central as soon as a communication connection to the data central is set up. For initiating the recrediting routine, the user enters an identification number (PIN) into the postage meter machine via a keyboard, this identifying the postage meter machine at the data central.

It is assumed that an authorized credit card processing center CPC and a data central collaborate in order, using the specific, second subregister that is maintained in the data central, to facilitate the reloading of postage meter machines with a credit balance for the user on the basis of credits. The prerequisite for the use of such a further payment possibility, of course, is the communication of a corresponding information to the data central and the offering of a corresponding data processing and memory capacity in the data central in order to process the aforementioned information. Based on a temporary communication connection between the authorized credit card processing center CPC and the data central and based on an associated transmission means and the maintaining of a further customer account belonging to the aforementioned, specific second subregister for payment at the credit card processing center, the data central performs that service which the customer requested that it perform.

An advantage of the method disclosed herein is that the customer need not preplan the next remote value entry and, accordingly, need not necessarily have money on hand in the specific, first account. Since, by contrast to a money transfer, a time span from a number of hours up to a number of days need not elapse because no money is transferred from the customer account of the credit card processing center to a specific account in the data central, there is a further advantage of time gained because the credit is immediately available. A further advantage connected therewith is in the financial gain since no loss of interest occurs because only the credit currently required need be offered as credit. This gain is diminished only by costs which may be potentially added due to an increased service fee to pay for this service. Fundamentally, the charging of the bank account at the customer's bank by the credit card processing center and the transfer of the credit item to the account of the carrier can occur after the remote value entry, i.e., after the reloading of the postage meter machine.

The minimization of the administrative outlay in the use of the specific, second subregister in the data central should be noted, both in the case of the customer and in the data central, particularly since no funds but only information are transferred. This advantage compensates for the disadvantage that the contact between the data central and the credit card processing center CPC lengthens the remote value entry process.

Proceeding on the basis of a postage meter machine having a microprocessor and a suitable program, and operating according to a method for improving the security of postage meter machines that includes an encryption of the transaction data, user-associated data communicated into the data central already forms a reliable basis in order to check the credit use or credit reloading data, present in stored form, for their plausibility and in order to initiate corresponding data processing events in the data central. This user-associated data include at least the identification number (PIN) and the values in the postal registers, for example, values about the credit use and the remaining amount of the postage meter machine that is still available.

In a first inventive version, the user-associated data can additionally include information about the type of payment, this being entered immediately after the identification number (PIN) via the keyboard of the postage meter machine. The information about the type of payment includes, for example, the credit card number and the expiration date of the credit card and, as warranted, information about the name of the authorized credit card processing center if the data central collaborates with a number of credit card processing centers.

After the end of the user entries, an automatic set-up of the communication connection to the data central in order to communicate the user-associate information inventively ensues automatically by the postage meter machine. An automatic transmission of information to the credit card processing center then ensues on the part of the data central when a credit card number has been received, including waiting for the authorization if the credit card processing center is momentarily not available, or repeating the communication with the credit card processing center if the connection is interrupted. The request for credit is automatically cancelled in the specific register of the data central if the connection is not set up after a predetermined number of attempts.

In a second inventive version, the user-associated data can additionally include information about the type of payment that is communicated during the course of the communication with the data central, i.e., information which is not communicated to the data central immediately after the PIN entry. The second inventive version includes the following steps.

A separate, first communication A is implemented, and the communicated, user-associated data additionally includes information about the type of payment that is communicated during the course of the communication with the data central, and this is entered into a specific mask.

A separate, second communication B is then implemented, causing the electronic postage meter machine to be switched into a reloading mode and the reset event and the booking thereof are implemented by the data central corresponding to the entry in the aforementioned, specific mask.

The user-associated data communicated from the postage meter machine only includes the identification number (PIN) and the values in the postal registers, and the information about the type of payment, which was communicated to the data central in a preceding, separate communication, is stored as a request in the form of a request code belonging to the identification number (PIN) or to the customer name in the data bank of the data central until another order is placed.

In a third inventive version, the user-associated data likewise includes only the identification number (PIN) and the values in the postal registers. An information about the type of payment is communicated to the data central in a preceding, separate communication.

Such an information about the type of payment, which is separately communicated at the entry or during the course of communication to and from the data central, switches the required data processing and memory capacity in the data central in order to process the aforementioned information.

DESCRIPTION OF THE PREFERRED EMBODIMENTS

Figure 1:
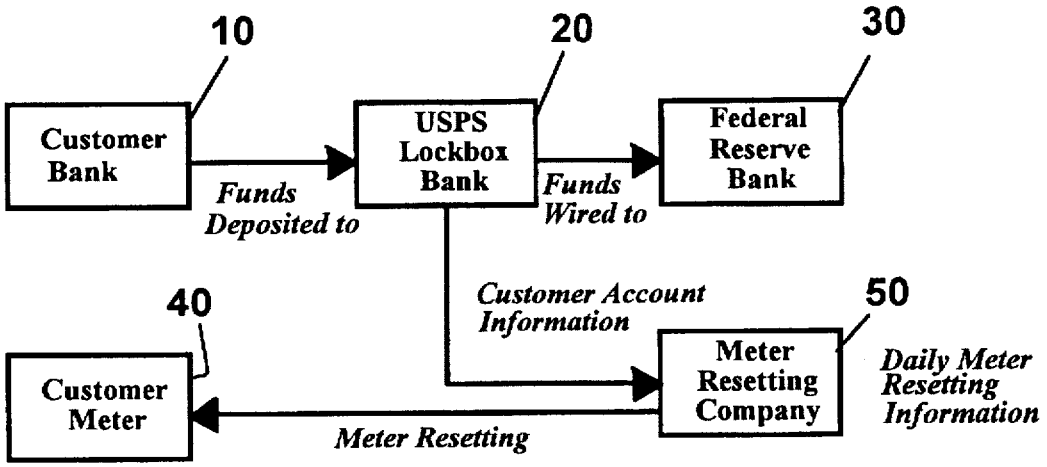
FIG. 1 is a block diagram of a service and data processing system of the data central for reloading a postage meter machine and for paying the carrier in accordance with the present invention.

FIG. 1 shows a preferred service and data processing system connected to a data central 50 for reloading a customer postage meter machine 40 and for paying the carrier, the data central 50 having a communicative connection to the postage meter machine 40. The funds required for the reloading are deposited by a first bank 10 (customer bank) authorized by the user of the postage meter machine, or are deposited directly by the user of the postage meter machine in an account in an authorized, second bank 20 (for example, USPS lockbox bank) and, when the credit is requested by the data central 40, the funds are transferred from the authorized, second bank 20 to a third bank 30 (for example, Federal Reserve Bank) which carries the account of the carrier. The credit request ensues by transmission of customer accounting information communicated from the data central 50 to the second bank when a request for reloading has been accepted as being proper.

A suitable postage meter machine has been disclosed, for example, in conjunction with a method for improving the security of postage meter machines in co-pending U.S. application Ser. No. 08/346,909, Windel et al., "Method for Improving the Security of Postage Meter Machines," corresponding to European Application 660 269 and assigned to the same assignee, Francotyp-Postalia, as the present subject matter. This postage meter machine is equipped with a printer module for a fully electronically generated franking format, with at least one input unit including a plurality of actuation elements, a display unit, a modem that produces the communication with a data central, a further input unit or a scale all of which are coupled via an input/output control module to a control unit. This postage meter machine also has non-volatile memories for data or programs that include data for the variable and the constant parts of the franking format. For reloading, this postage meter machine is switched to a communication mode by the user. The user-associated information communicated to the data central includes the identification number (PIN) and the values in the postal registers. This postage meter machine, for example, can communicate the following postal register values to the data central before a credit reloading:

- R1 (descending register), which is the balance of account remaining in the postage meter machine;
- R2 (ascending register) which is the total amount used in the postage meter machine;
- R3 (total resetting), which is the previous overall input sum of all remote value inputs;
- R4 (piece count $\Sigma$ printing with value $\neq 0$), which is the number of valid impressions; and R8 (R4+piece count Σ printing with value =0), which is the number of all impressions.

The data central stores the communicated register data belonging to each postage meter machine, respectively identified by its PIN. With the PIN, the desired input request for a future reloading was already registered in a preceding communication or transaction. The stored input request VGW can be modified during a preceding transaction in accord with the input of the postage meter machine User in order to load a reloading value NLW into the postage meter machine corresponding to the input request in a reloading event that ensues later.

Further, a check can be carried out in the data central to determine whether the following equation is satisfied:

$$R3=R2+R1. \quad (1)$$

The remaining credit balance R1 on hand can be interrogated and statistically evaluated in the data central before each remote value input of a reloading credit for the descending register.

Figure 2:
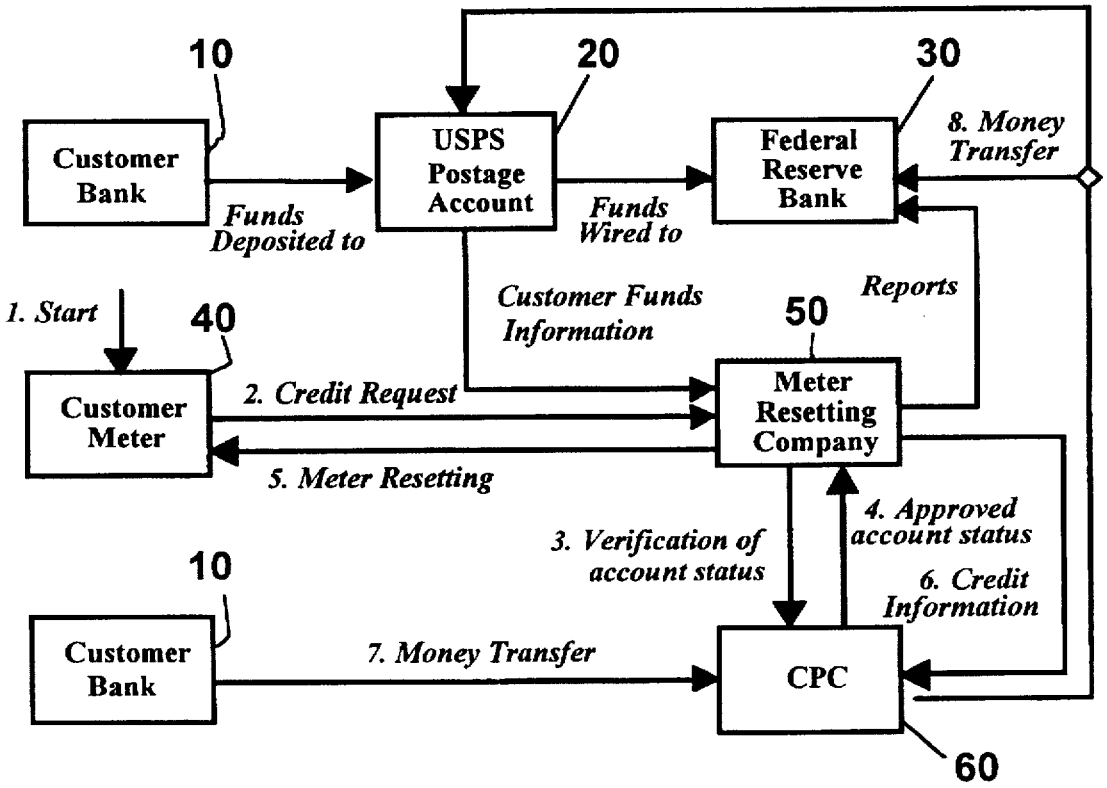
FIG. 2 is a block diagram of an expanded service and data processing system of the data central for reloading a postage meter machine and for paying the carrier in accordance with the present invention.

According to a first version of the present method and apparatus, a postage meter machine such as disclosed in Ser. No. 08/346,909 is equipped with a specifically expanded program that enables the user of the postage meter machine to enter the required, user-associated information about the form of payment in addition to the identification number (PIN). FIG. 2 shows an inventively expanded service and data processing system connected to the data central 50 for reloading a postage meter machine 40 and for paying the carrier.

This service and data processing system for the data central 50, which is in communicative connection with the postage meter machine 40, uses the services of a credit card processing center 60 for reloading a postage meter machine 40. For example, such a credit card processing center 60 is a credit card processing center (CPC) such as Citibank® which undertakes a debiting from the customer account from the first bank 10 (customer bank) authorized by the user of the postage meter machine 40 corresponding to the credit used for reloading the postage meter machine with the required funds. Such a debiting from the customer bank 10 can ensue, for example, by a debit note method. The allocation of the basic steps 1–8 to specific communication connections may be seen from FIG. 2.

Of course, the payment possibility set forth in FIG. 1 is likewise retained. In the latter, the funds required for reloading are deposited by the first bank 10 (customer bank) authorized by the user of the postage meter machine or are directly deposited by the user of the postage meter machine in an account in an authorized, second bank 20 (for example, USPS Lockbox Bank), and, when the credit is requested by the data central, it is transferred from the authorized, second bank 20 to the third bank 30 (for example, Federal Reserve Bank) which carries the account of the carrier. The credit request ensues by customer debiting information communicated from the data central 50 to the second bank 20 when a request for reloading has been accepted as proper.

Figure 3:
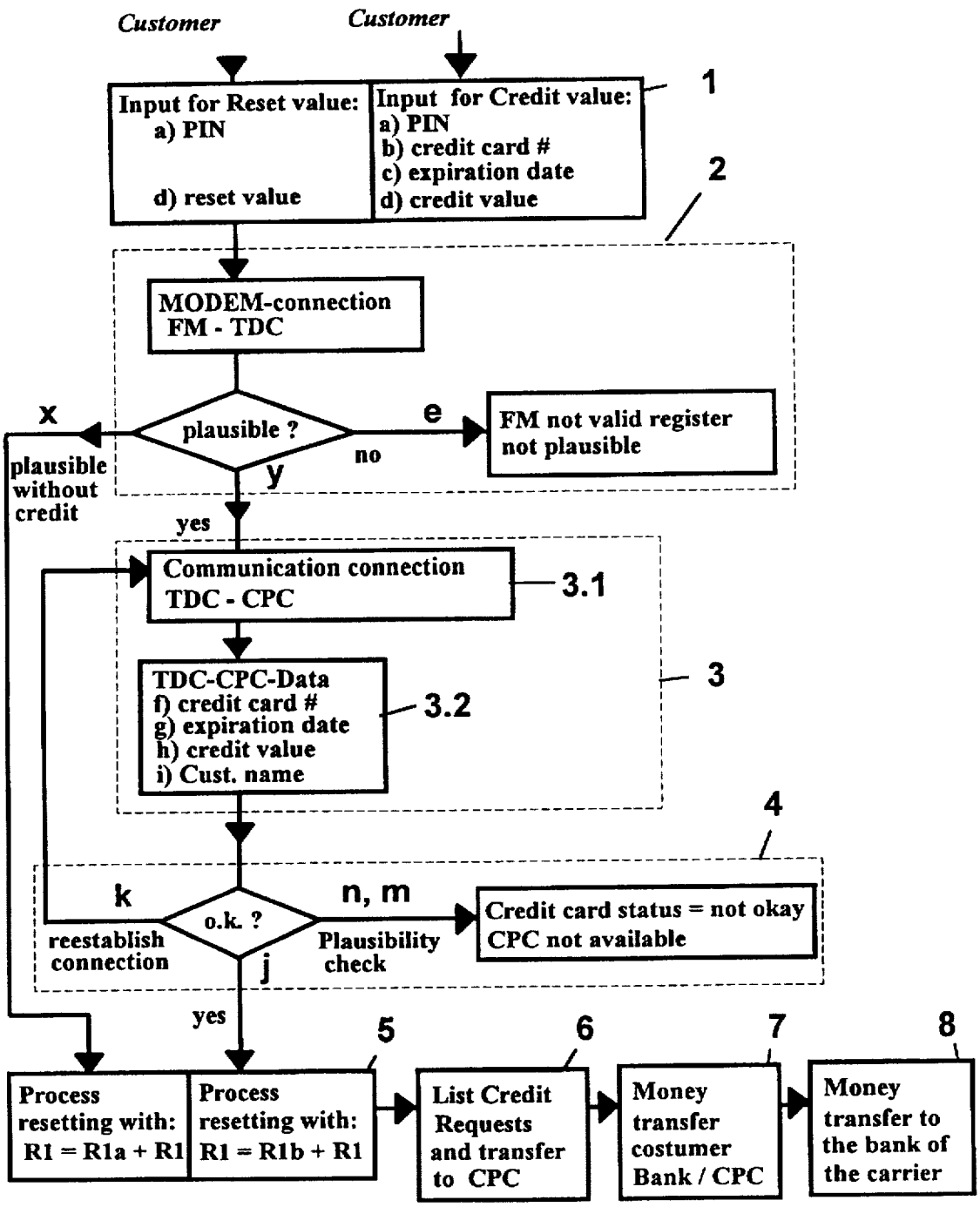
FIG. 3 flowchart for the credit inquiry according to a first embodiment of the inventive method.

A flowchart for the credit inquiry according to the first version is shown for the first six steps in FIG. 3, these being undertaken by the data central 50. The method according to the fist version proceeds on the basis of a service provided by the data central in conjunction with the specific credit card method implemented in the postage meter machine. The complete method includes the steps 1–8 that can be done without having to add to the hardware outlay of the postage meter machine 40. Only a program modification is required in the postage meter machine 40. The aforementioned steps 1–8 are as follows:

1. Data input and switching of the postage meter machine into a communication or credit inquiry mode. The postage meter machine switches into a credit inquiry mode when the postage meter machine user or, respectively, customer starts the credit inquiry with a data input entered via the keyboard of the postage meter machine by means of the following steps, that are respectively confirmed by actuation of a special actuation means (key):
   a) Input of the personal identification number PIN (8 digits).
   b) Input of the credit card number Credit Card # (16 digits)
   c) Input of the validity term Expiration Date (4 digits, for example 0797),
   d) Input/confirmation of the credit value Reset Credit Value (for example, $500). If by contrast, only the substeps a) and d) are implemented but the substeps b) and c) of step 1 are not implemented, the postage meter machine proceeds into a communication mode—disclosed in the aforementioned co-pending application Ser. No. 08/346,909—in order to reload the postage meter machine with a credit according to the service version shown in FIG. 1. The input of the very long credit card number credit card # is entered with a "left-scrolling" method. The postage meter machine is programmed such that the display shifts one position toward the left after the ten available display fields have been written, so that the next numeral can be entered. After the complete data input has been implemented, i.e. credit card number, expiration date and credit value have been successively entered and acknowledged, the credit inquiry process is automatically started.
2. Set up of a communication connection to a data central, plausibility check of the input data and communicated register values in the data central and start of the credit inquiry or start of the reloading process with a pre-paid credit. The start of the communication with the data central is, for example, via a modem connection, is automatically triggered by the postage meter machine and thus the credit inquiry process is started after an input by actuation of a predetermined key or key combination. The user-associated information, including the information about the form of payment is thus transmitted by modem to the data central 50 and is further-processed in a data processing system therein. After a plausibility check (for example, PIN, authorization of the postage meter machine in the name of the customer, plausibility of the register values, correctness of the credit card number credit card number and other data, etc.), the data central 50 subsequently contacts either the credit card institute-for example credit card processing center 60)—on (branch path y) for the purpose of a credit inquiry or the credit inquiry is rejected. This event is indicated to the user or customer with a corresponding error message on the display of the postage meter machine 40 when the service cannot be performed (branch path e) or, corresponding to the input, a different service (branch path x) is performed. The credit card number credit card number is neither deposited in the postage meter machine nor checked therein, but is merely taken into consideration in the transmission protocol during the communication mode. The input credit card number credit card number is communicated to the data central and is compared therein to the stored credit card number. When a valid credit card number is communicated, a branch is made after y to step 3. Otherwise, when no credit card number was communicated but both the communicated PIN and register values are plausible, a branch is made after x to step 5 in order to process the reset event on the basis of the system shown in FIG. 1. Upon receipt of a new credit card or when an old credit card has become invalid, the customer need merely inform the data central 50 during a separate communication before the credit inquiry. The data central 50 then undertakes a corresponding storing of the modification in its data bank. Given a faulty input of the credit card number credit card number, the credit inquiry is aborted with an error message from the data central 50 (branch path e).

3. Making contact with and sending information to the credit card institute CPC for verification of the credit card status. For the purpose of a credit inquiry, the data central contacts the credit card institute (substep 3.1). Before the postage meter machine can be newly loaded with the reset credit value, the following information is exchanged between the data central 50 and the credit card institute 60 via a separate communication connection (substep 3.2):

f) Credit card number Credit Card # g) Validity duration Expiration Date h) Reset Credit Value i) One customer name customer name.

The account status of the credit card user is to be interrogated by the credit card institute 60 with this information in order to thus serve as a further security feature. The customer name customer name is stored allocated to a corresponding PIN only in the data central. The customer name is not stored in the postage meter machine.

4. Receiving the authorization of the proper credit card status in the data central or error display. The credit card processing center 60 checks the account status of the credit card owner with corresponding, internally available check routines and answers the data central 50 in one of the following ways:

j) Credit card status okay n) Credit card status not okay m) CPC momentarily unavailable k) Connection is interrupted.

The reply to the data central 50 usually sequences within 30–60 seconds. No account is kept in the data central 50 and no transfer of funds from the credit card processing center 60 to the account maintained in the data central is caused. Dependent on the reply, on the contrary, either the requested, new credit continues to be intermediately stored, or it is cumulatively intermediately stored in a specific, second subregister in the data central 50 in conformity with the request of the service customer, or it may be cancelled, according to the subroutine:

j)/n) Credit card status okay/not okay
if credit card status=okay then
tdc_credit=tdc_credit+reset_credit_value
reset_process_event
else fm_error (no_credit)

If the credit card processing center 60 could not be reached, the branch path m is taken, the requested credit amount in the specific, second subregister in the data central 50 is erased and an error is displayed according to the subroutine:

m) CPC momentarily unavailable
if repeat_counter++max_ repeats then fm_error (cpc_not available).

If the connection has merely been interrupted, a branch path k is first taken and a branch back is made to step 3 according to the subroutine:

k) Connection was interrupted
if bad_cpc_connection then repeat_credit_process
if repeat_counter==max_repeats then fm_error (no_cpc_connection).

The branch path m is likewise taken and the requested credit amount in the specific, subregister in the data central 50 is erased and an error is displayed when the connection is repeatedly interrupted even after a predetermined number of repetitions or attempts to set up the connection again, i.e., when the credit card processing center 60 could not be reached. The erasing of the requested credit amount is communicated to the credit card processing center 60 from the data central 50, whereupon the credit card processing center 60 annuls the credit order. No effect on the credit card processing center 60 and data central 50 thus occurs given transaction errors.

5. Processing the reloading event. The data central processes the reply of the credit card processing center CPC accordingly. An automatic handling of the reloading event ensues in the data central, and an entry of the credit value in the specific, second subregister R1*b* of the data central 50 is undertaken given an okay credit card status (branch path j). Otherwise (branch path x), an automatic entry of the reload value NLW ensues into the specific, first subregister R1*a* of the data central 50. The reset debit value NLW or credit value (reset credit value) is then added to the existing remaining credit balance in the postage meter machine 40 according to the input request VGW and is likewise added in the data central 50 and the credit inquiry is then ended. Otherwise, when an error was displayed (branch path n) or when the credit card processing center 60 could not be reached or when the connection was interrupted and a branch path k) was first taken and when the credit card processing center 60 could still not be reached, the requested credit value is erased in the specific, second subregister in the data central 50 and an error is displayed. The postage meter machine user, however, then still has the possibility of a normal reloading from the specific, first subregister by setting the communication mode, as set forth under step 1.

6. Communication of listed information about successful credit inquiries that have resulted in reloading. After the lapse of a specific time period (daily, weekly, monthly), a list of all successful credit inquiries is prepared by the data central 50 and is communicated to the credit card processing center 60 with corresponding data carriers and/or via a communication connection, for example modem or ISDN. The data central 50 waits for a confirmation of the transmission of the list.

7. Money transferred between credit card processing center and the customer bank. The money transfer must be implemented between the credit card processing center 60 and the bank 10 of the customer so that (in the next step 8) the money transfer between the credit card processing center 60 and the bank 30 of the national Postal Service, or the lockbox bank 20 can be organized in a suitable way.

8. Implementation of transfers to the bank of the carrier. With the aforementioned credit inquiry list, the credit card processing or the customer bank 10 is requested to transfer the total credit amount that has been readied either directly to the bank 30 of the national Postal Service (e.g. Federal Reserve Bank) or to the authorized bank 30 (USPS lockbox bank).

Figures 6, 7:
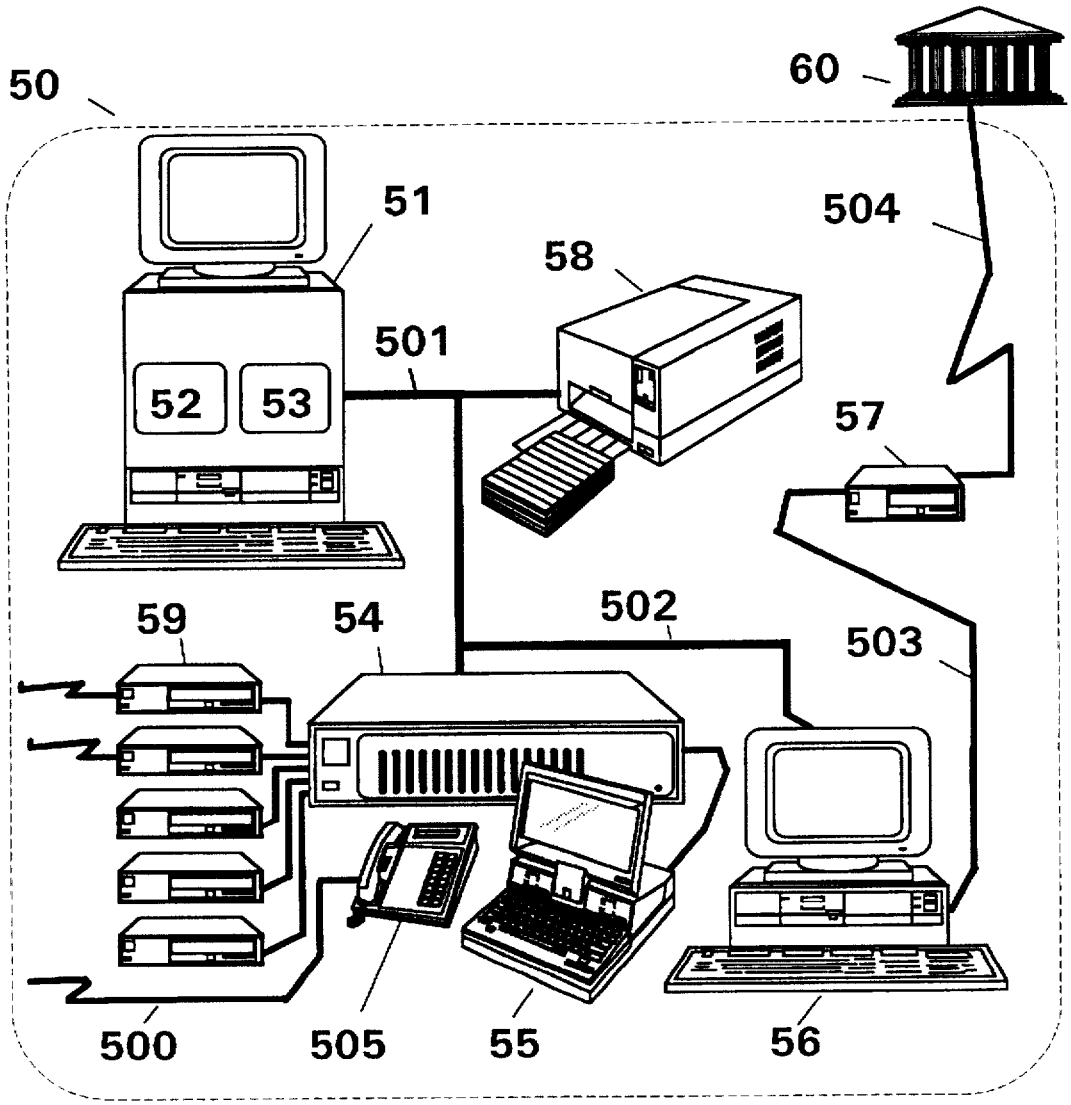
FIG. 6 illustrates an arrangement for the credit inquiry in the data central in accordance with the present invention.
FIG. 7 illustrates an arrangement and allocation of the subregisters or registers in the memory area of the data bank in accordance with the present invention.

FIG. 6 shows an arrangement for the credit inquiry in the data central 50. At least one host computer 51 is arranged in the data central 50 that has a stored data bank 50 and a stored program 53 for the credit inquiry. The host computer 51 is connected via line 501 to at least one programmable input/output unit 54 for the implementation of a communication via respective communication connections 59 (modems) with the postage meter machines (not shown) and for the implementation of a communication via communication connection described below to the bank or financial/credit institute 60 for payment of the reloading of postage meter machines with a credit that can be optionally prepaid or post-paid. It is inventively provided that the memory units 52 and 53 are each a hard disk or that one hard disk is provided as both the memory unit 52 and as memory unit 53.

The arrangement for the implementation of the method and for the operation of a data central includes memory location in the aforementioned data bank for registering entries for offering and producing specific services corresponding to a customer request with a postage meter machine access or a TDC operator access for entry of the customer request.

The data bank 52 preferably stored on a hard disk and a program 53 for the credit inquiry, which is likewise present stored on a hard disk, together with the programmable input/output unit 54 form a first service unit that is in communication with the postage meter machines via the communication connections 59 and also is in communication with at least one operator terminal 55.

A second service unit is composed of a second programmable input/output unit 56 which is in turn coupled to the host computer 51 via lines 501 and 502 and is also coupled via a line 503, 57 and 504 to a bank terminal (not shown) or to the bank personal computer in the credit bank or financial institute 60.

The second programmable input/output unit 56 has access to the data bank 52 in order to obtain and transmit information to the credit card processing center 60 for verification of the debiting status and in order to implement the reception of the authorization of the okay credit card status (steps 3 and 4) as well as, as required, to implement a communication of listed information about successful credit inquiries (step 6). Alternatively, a printer can be coupled to the host computer 51 in order to print the lists out. Additionally, alternative data carriers CD-ROM, diskettes, etc. can be written with the aforementioned data in order to store this data, the data being written with appropriate registration means (not shown) of the host computer 51.

The data central 50 makes respective memory location available in the data bank 52 for two specific subregisters allocated to the accounts of the postage meter machine user in order to undertake a corresponding transaction. It is thereby provided that a credit is transferred from a first bank (customer bank) or directly from the postage meter machine user into a first bank account at a specifically authorized second bank or financial institute communicatively coupled to the data central 50. A credit corresponding to the prepaid amount is maintained in the specific, first subregister of the data central 50, and in accordance with the invention a specific, second subregister is maintained in the data central 50 for allocating the credit transaction.

It is likewise provided that the first programmable input/output unit 51 has access to the data bank 52, so that the data central 50 can be authorized by the customer to perform a corresponding service for the reloading or recrediting of his postage meter machine in order, as required, to have the money transferred in a predetermined way onto the account at a third bank specifically authorized by the carrier, or into the account at the bank of the national Postal Service in order to pay for the service of the carrier.

FIG. 7 shows the required memory areas which must be made available in the data bank 52 in order to enable the revision of the registers or keeping the accounts about the performed service. Together with the PIN, the desired crediting request VGW for a future reloading with the reloading value NLW or the desired credit value for a future reloading is registered with an order date. A reloading value is only entered upon the implementation of the reloading or reset event (step 5). A register value R1 is then updated by forming the sum of the subregister values R1*a* (prepaid value) and R1*b* (credit). The data central 50 stores the communicated register data R2 for the amount used in the franking, and stores R4 and R8 for the piece numbers of frankings belonging to each postage meter machine (that can be respectively identified by its PIN), and forms a new checksum R3=R1+R2.

In further, second and third inventive versions, further memory areas—not shown in FIG. 7—are made available in the data bank 52 in order to enable the revision of the registers or accounting about the service performed. Together with the PIN, the name of the postage meter machine user, an order code and an order date and the desired reloading value for a future reloading, are registered.

Figure 4:
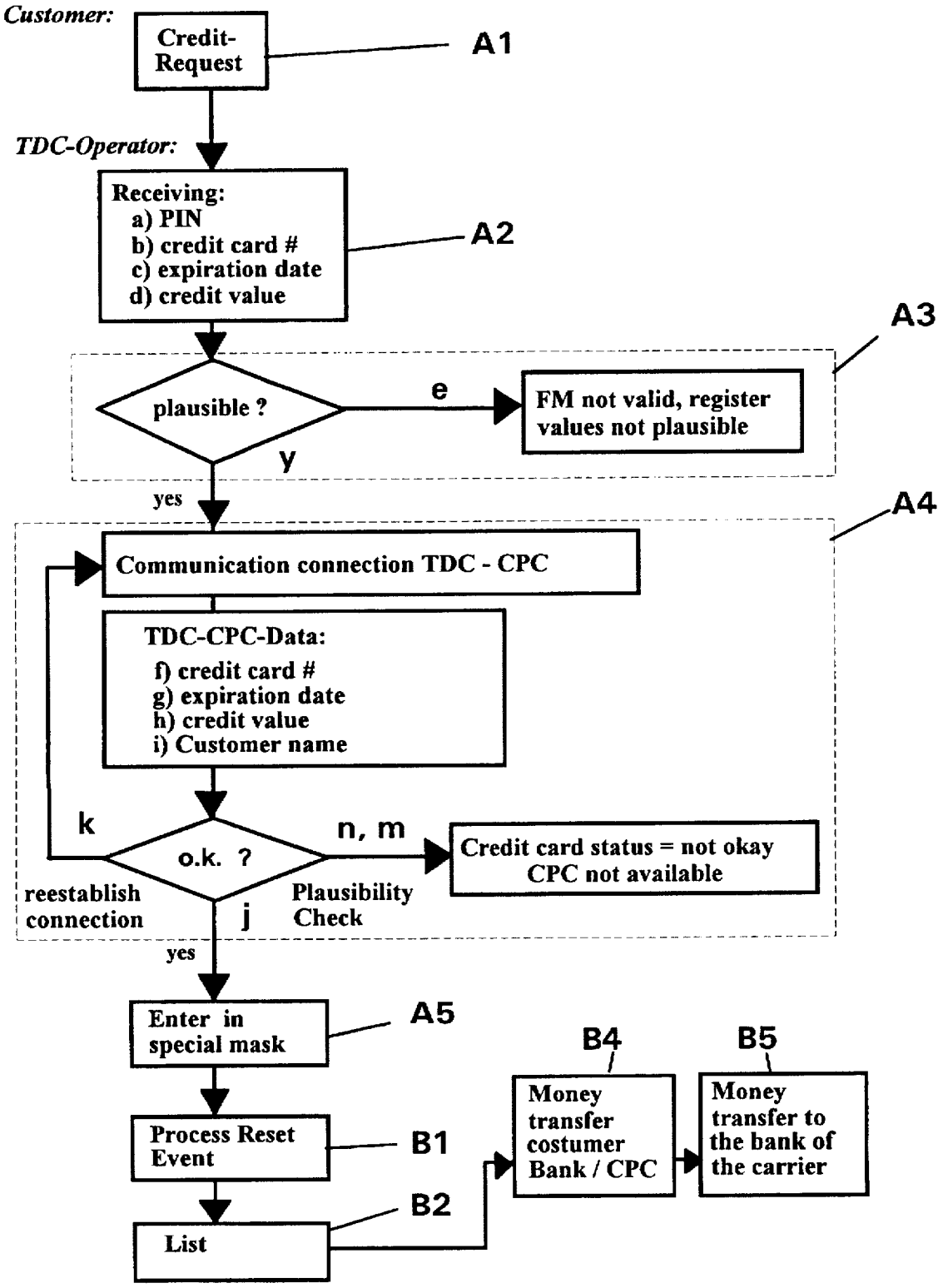
FIG. 4 flowchart for the credit inquiry according to a second embodiment of the inventive method.

A second version of a flowchart—shown in FIG. 4—for the credit inquiry proceeds on the basis of an economical realization by employing a standardized Quick Pro System with an external TDC-CPC computer. The coupling with the data bank 52 in the host computer 51 is produced via an operator terminal of the first or of the second programmable input/output unit.

This method is also is dependent on the type of postage meter machine, i.e. no new software version is necessary for the postage meter machine. This method is analogous to the method described in the third version; however, a customer can have the remote value input based on credit cards implemented only dependent on the data central operator. The disadvantage that a data central operator is involved in this remote reloading process and, thus, "human" error sources are present, is countered by a more economical realization and provides a person-to-person communication, which some users prefer.

All auxiliary information with respect to credit card users is stored in updatable form in the data bank 52 at the data central 50. A hard disk can preferably accept the aforementioned data bank 52. In a separate, first communication A to the data central 50, the data of the postage meter machine and information about the form of payment are communicated. In a separate, second communication B to the data central 50, the actual remote value input is undertaken, as was disclosed in the aforementioned co-pending U.S. application Ser. No. 08/346,909. The following steps occur in sequence:

A1. A customer calls the data central 50 and expresses his request to the operator at the data central 50 (via telephone link 500 using a telephone apparatus 505) to load his postage meter machine via a credit card.

A2. The data central operator receives the request and the disclosure of the PIN, the credit card number, and the loading amount.

A3. The data central operator implements a plausibility check.

A4. The data central operator establishes communication with a separate CPC computer in the credit card institute. The liquidity of the credit card is checked via the separate CPC computer in the credit card institute in the form of an "okay" or "not okay" message received by the data central via a modem connection (duration approximately 20 seconds).

A5. Given a positive confirmation, the TDC operator enters the requested amount into a specific mask credit card payment running under the TDC program, with indication of the PIN, the credit card number and the credit amount. The amount is entered into the specific, second subregister of the customer in the data central 50.

B1. Processing the reloading event or return to step A1 for repeating the input for the credit inquiry mode or for switching the postage meter machine into a communication mode. The customer can now load his postage meter machine with the requested amount. The following check subroutine occurs during the loading event:

if fwv_amount_in_normal_account_available then regular fwv else check_whether_credit_card_user if credit_card_user then check_whether_coverage_exists else error message (no_credit).

B2. Communication of listed information about successful credit inquires. When a remote value input was sequenced via the specific, second account, and was referred to the credit card account of the customer, the postal authority must be informed thereof in a separate report. Otherwise, a data carrier is produced for the credit card processing center on a daily, weekly or monthly, so that the loaded remote value input amounts can be transferred to the postal authority. (For this purpose, as shown in FIG. 6, the host computers 51 can be connected via line 501 to a printer 58.)

B4. Money transfer between credit card processing center 60 and the customer bank 10.

B5. Implementation of transfers to the bank 30 of the carrier.

Figure 5:
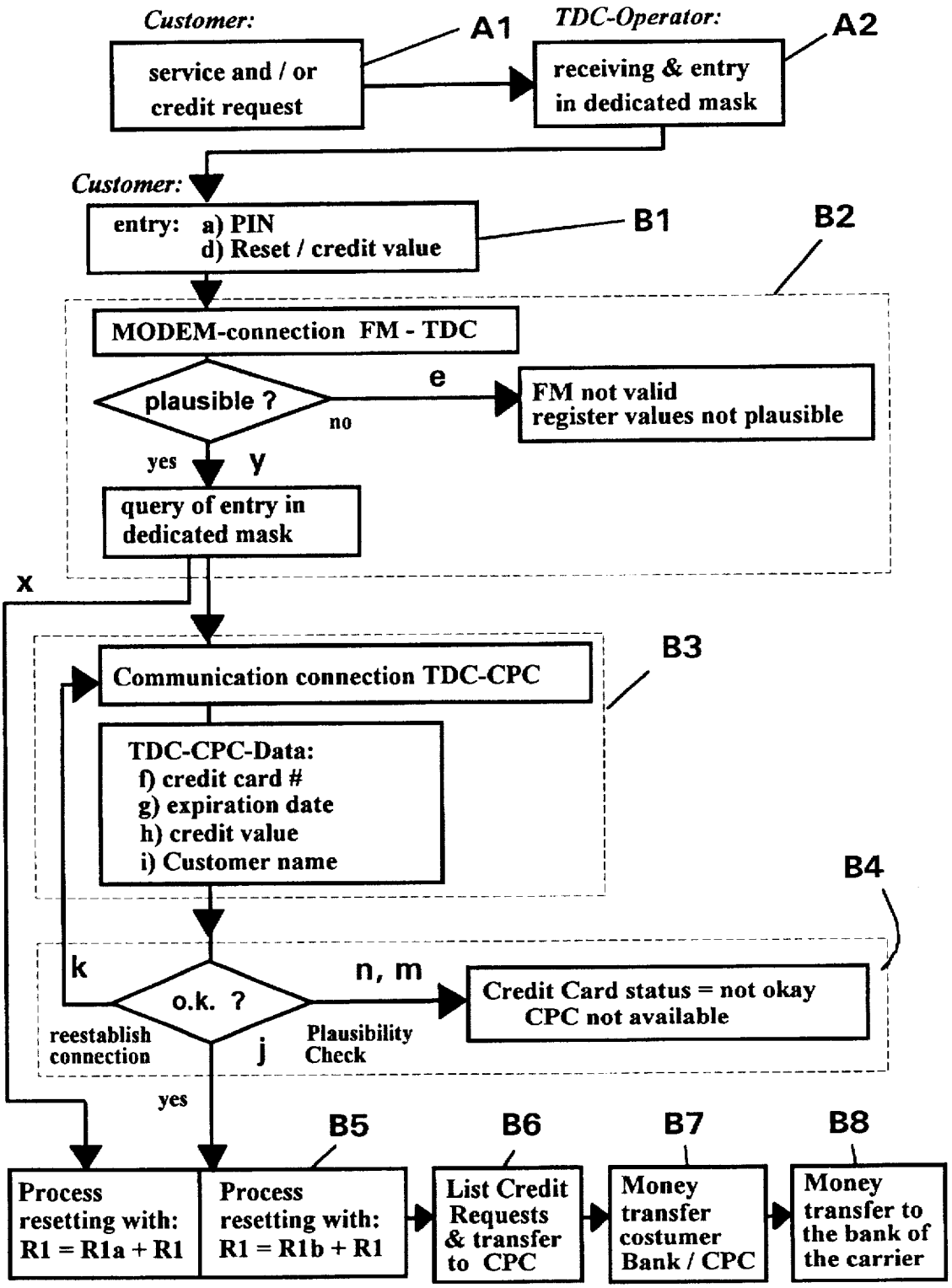
FIG. 5 flowchart for the credit inquiry according to a third embodiment of the inventive method.

FIG. 5 shows a flowchart for the credit inquiry according to a third version. This third version relates to a corresponding, fully automated credit card method executed via CPC on-line connection with an external CPC computer. Corresponding hardware and software means are arranged or utilized in the data central 50 in order to implement a credit card procedure associated to postage meter machines for standard postage meter machines as well. This method is likewise independent of the postage meter machine type, i.e. no software adaptation measures are required in the postage meter machine. Auxiliary information with respect to credit card users is stored in a data bank of the data central, such as on a hard disk. In a separate execution, the following steps are implemented in advance:

A1. The service customer calls the data central 50 (TDC) by telephone and expresses his wish to the TDC operator. A service request, for example, can be loading the postage meter machine of the customer with a credit card only for future use. Another service request, for example, can be comprised in only loading the postage meter machine of the customer via a credit card when a first customer account, what is referred to as the reloading account, is exhausted.

A2. The TDC operator listens to the customer's request and confirms the order. The TDC operator enters corresponding inputs into a specific mask running under the TDC program; an allocation of order code to PIN of the person giving the order is thus achieved.

Differing from step 1 of the first version, however, no input for switching the postage meter machine into a credit inquiry mode ensues in the setup of a following communication B; rather, only an input for switching the postage meter machine into communication mode ensues as disclosed in the aforementioned co-pending U.S. application Ser. No. 08/346,909. All services of the data central 50 can thus likewise be available for standard machines without a retrofitting action, since information about the form of payment was communicated to the data central 50 in a previously implemented, separate communication A which remains stored in valid form until a repeated implementation of a separate communication A with the data central 50. The following steps occur in sequence in a communication B with the data central 50:

B1. Input for switching the postage meter machine into a communication mode. The postage meter machine user or the service customer switches the postage meter machine into the communication mode. In step 1, he begins the input of the PIN as well as the input of the reloading amount.

a) Input of the personal identification number PIN (8 digits)

b) Input/confirmation of the credit value Reset Credit Value (for example, $500).

B2. Start of the communication routine and plausibility check in the data central 50. The postage meter machine automatically starts a routine-by setting up the communication connection—as in an entirely normal remote value input for the requested reloading amount in the data central. A plausibility check follows, whereby the communicated PIN and the communicated register values are checked in the data central 50. The system may determine, for example, the customer name but, with reference to the entry of the specific, first subregister, also determines that no credit or inadequate credit is located on the specific, first credit account and subsequently checks whether the current customer is a credit card user. When, in addition to having the credit account, the customer also has a credit card account, one proceeds further as above. Otherwise, the communication is aborted with an error message from the data central 50. The processing of the reloading request ensues from the data central 50 corresponding to the specific service order. By means of an affiliation—not shown in FIG. 7—of further registers to the PIN, an order code together with an order date and the customer name are now additionally registered in a preceding communication or transaction, in addition to the requested input wish for a future reloading. When, for example, the service order is in loading the postage meter machine of the customer with a credit card only for future use but the specific, first account still has too little credit in order to satisfy the reloading request, the specific, first account is tapped again for the last time and the specific, second subregister R1*b* in the data bank 52 of the data central 50 stores the lacking difference that has been resorted to as a credit at the credit card processing center 60 in order to supply the missing difference. During later reloading requests, the specific, second subregister R1*b* in the data bank 52 of the data central 50 supplies the full amount corresponding to the respective reloading request. The procedure is analogous for another type of service request is implemented, i.e., loading the postage meter machine of the customer via credit card only when the first customer account, what is referred to as the reloading account, has been exhausted. A specific, first account is thereby merely constantly resorted in order to satisfy the reloading request and, as required, the lacking difference that was resorted as credit at the credit card processing center CPC is noted for debiting purposes in the specific, second subregister R1*b*.

B3. Contacting and sending information to the credit card processing center 60 for verification of the debiting status. In substep B3.1, a separate communication connection is set up between the data central 50 and the credit card processing center 60. In substep B3.2, the following information are exchanged between the data central 50 and the credit card processing center 60 via a separate on-line connection:

f) Credit card number Credit Card # g) Validity duration Expiration Date h) Credit value Reset Credit Value i) Customer name customer name.

The credit card processing center 60 checks whether the credit card number that was stored in the data central 50 is valid.

B4. Receiving the authorization of the "okay" credit card status in the data central 50. In step B4, the credit card processing center 60 delivers an "okay" to the data central 50 if the liquidity of the customer, i.e. the validity of the credit card, is acceptable (duration of approximately 20 seconds). Otherwise, the credit card processing center 60 supplies a NOT_OK if the inquiry was answered in the negative. The reception of the message in the data central is connected with a corresponding evaluation as was already set forth in greater detail under step 4 of the first version. In step B4, the requested credit amount—given a positive confirmation corresponding to the data central program—is automatically entered into a specific mask for credit card payment upon indication of the PIN, the credit card number and the credit amount and is stored.

B5. Processing the reloading event or return to step 1 for repeating the input. If the inquiry was answered in the positive, the regular remote value input is subsequently continued with the requested reloading amount, whereby the debiting in the data central 50 and the payment, corresponding to the request already accepted by the data central operator during the course of communication A and stored, is controlled in step B5. The postage meter machine can now load the desired amount. The following check occurs during the loading event:

if fwv_amount_in_normal_account_available then regular fwv else check_whether_credit_card_user if credit_card_user then check_whether_coverage_present else error message (no_credit).

The credit amount is cumulatively stored according to the credit in an account referred to as the credit card account in the specific, second subregister of the data central 50, i.e., in an intermediate memory, until the debiting between the credit card processing center 60 and the data central 50 has been implemented analogously to the method described under step 6. To this end, a specific, first subregister R1*a* corresponding to the specific, first account of the customer as well as a specific, second subregister R1*b* as a second part of the descending register corresponding to the specific, second account of the customer are maintained in the data bank 52 in addition to a first descending register R1. The sum of the subregisters R1*a* and R1*b* is equal to the balance of account still available in the postage meter machine and the following equation is valid:

$$R1=R1a+R1b \quad (2)$$

The descending register value in R1 of the data central thus corresponds to the descending register value in R1 that was stored in the postage meter machine up to the switch into a communication or remote reloading mode. When the value is accumulated in the specific, second subregister R1*b*, this constitutes authorized credits. A credit that is transferred into the specific, first account of the customer according to the way shown in FIG. 1 in order to replenish the balance of account in a conventional way is thus first initially stored in the specific, first subregister R1*a*. Subsequently, a point in time is reached at which the specific, first subregister value in R1*a* as well as the descending register value in R1 are replenished by that value that is stored in the specific, subregister R1*b*. The replenished value is substituted in the specific, second subregister R1*b* and the new value in the specific, second subregister R1*b* is then zero and the value in R1*a* then corresponds to the descending register value in R1 that is also stored in the postage meter machine.

B6. Communication of listed information about successful credit inquiries. When a remote value input was sequenced via the specific, second subregister R1*b* allocated to the credit card account of the customer, the postal authority must be informed (step B6) in a separate report. A data carrier for the credit card processing center 60 is also produced daily, weekly or monthly, so that the amounts of loaded remote value input can be transferred to the postal authority.

B7. Money transfer between credit card processing center and the customer bank.

B8. Implementation of transfers to the bank of the carrier.

Advantages are achieved by the inventive method and apparatus due to the fast availability of such a system, because standard products can be utilized, and thus no adaptation measurers are required at the postage meter machine. This service can thus be performed as required for all products already being utilized, i.e., for all products already out in the field.

We claim as our invention:

1. A method for paying for recrediting an electronic postage meter machine switchable into a credit reloading mode, comprising the steps of:

entering data into an electronic postage meter machine and switching said postage meter machine into one of a communication mode or a credit inquiry mode;

establishing communication between said electronic postage meter machine and a data central;

conducting a plausibility check at the data central of the data entered into the postage meter machine;

beginning a reloading sequence by entering one of a credit card number of a user of said postage meter machine or a prepaid credit;

establishing communication between said data central and a credit card processing center and transmitting information relating to said credit card number of said user from said data central to said credit card processing center for verification of a credit card status of said user;

receiving authorization to proceed at said data central from said credit card processing center if said credit card status is acceptable at said credit card processing center, or displaying an error and discontinuing said reloading sequence if said credit card status is not acceptable at said credit card processing center;

processing said reloading sequence at said data central to reload funds on said electronic postage meter machine including making an entry in a list of successful credit inquiries if said credit card status is acceptable at said credit card processing center;

electronically transferring funds between said credit card processing center and a bank of said user of said postage meter machine at least equal to funds reloaded in said electronic postage meter machine; and transferring funds at least equal to the funds reloaded into said electronic postage meter machine from said bank of said user to a bank of a nationally authorized postal carrier.

2. A method as claimed in claim 1 wherein the step of establishing communication between said data central and said credit card processing center comprises automatically transmitting information relating to said credit card number from said data central to said credit card processing center when said credit card number is entered;

waiting for authorization from said credit card processing center at said data central if said credit card processing center is not immediately available;

repeating the establishment of communication between said data central and said credit card processing center if said communication is interrupted and paying for unsuccessful communication establishment attempts; and erasing a credit request in a predetermined register at said data central if communication is not established between said data central and said credit card processing center after a predetermined number of attempts.

3. A method as claimed in claim 1 comprising the additional steps of communicating a list of valid credit inquiries to said credit card processing center from said data central for verification of said transfer of funds from said bank of said user.

4. A method as claimed in claim 1 comprising the additional step of:

waiting for confirmation at said data central by said credit card processing center or said bank of said user before proceeding with said reloading sequence.

5. A method for paying for recrediting an electronic postage meter machine switchable into a reloading mode, comprising the steps of:

entering user-associated data containing information about a form of payment into said electronic postage meter machine immediately after entering an identification number into said postage meter machine;

switching said postage meter machine into one of a communication mode or a credit inquiry mode;

automatically establishing communication with a data central and transmitting said information to said data central from said electronic postage meter machine;

establishing communication between said data central and a credit card processing center and transmitting said information from said data central to said credit card processing center for verification of a credit card status of said user;

receiving an authorization at said data central from said credit card processing center verifying acceptance of the credit card status of said user or receiving and displaying an error if said credit card status is not acceptable; and automatically processing a reloading sequence at said data central in the case of an accepted credit card status and entering a credit value into a predetermined subregister of said data central.

6. A method as claimed in claim 5 wherein the step of entering said user-associated data containing information about a form of payment comprises entering a credit card number, an expiration date of the credit card.

7. A method as claimed in claim 6 wherein the step of entering said information about the form of payment further comprises entering a name of a credit card processing center if said data central is capable of communicating with a plurality of different credit card processing centers.

8. A method for paying for recrediting of an electronic postage meter machine switchable into a reloading mode, comprising the steps of:

conducting a separate, first communication between an electronic postage meter machine and a data central wherein user-associated data is communicated to said data central, including information about a form of payment, said information about said form of payment being entered in a specific mask;

conducting a communication between said data central and a bank of a user of said postage meter machine to receive authorization to credit funds to said user; and upon receiving said authorization, conducting a separate, second communication between said electronic postage meter machine and said data central wherein said electronic postage meter machine is switched into a reloading mode and wherein a transaction corresponding to said entry in said specific mask is conducted at said data central including crediting of said funds to said user.

9. A method as claimed in claim 8 wherein the step of entering said user-associated data comprises entering an identification number and a requested postal value into respective registers in said postage meter machine, and comprising the additional steps of storing information about said form of payment communicated to said data central in a preceding first communication in a data bank of said data central associated with said identification number until another first communication is made by the same user, and using said information stored in said data bank for processing a current, first communication from said user.

10. A method as claimed in claim 8 wherein said first communication comprises:

placing a customer-originated telephone call to an operator at said data central and said customer informing said operator of an intent to load said electronic postage meter machine using a credit card;

said customer informing said operator of the customer's personal identification number, credit card number and reloading request;

implementing a plausibility check by said data central operator;

said data central operator communicating with a separate credit card processing center operator to verify a liquidity of a credit card account owned by said customer at said credit card processing center via a separate computer at said credit card processing center;

receiving an acceptance or non-acceptance by said data central operating from said credit card processing center operator;

given an acceptance, said data central operating entering said reloading amount into a specific mask credit card payment by identifying at said data central in a data central program the personal identification number, the credit card number and the reloading amount and writing said credit card payment into a predetermined second register dedicated to said customer at said data central;

and wherein said second communication comprises:

returning to the step of said customer calling said data central operator if said credit card processing center did not verify the customer's credit and repeating said first communication;

if said credit card center verified said customer's credit, switching said postage meter machine into a communication mode with said data central station;

communicating a list of successful credit inquiries;

said credit card processing center initiating a transfer of funds from said bank of said customer; and transferring said funds to a bank of a nationally authorized postal carrier.

11. A method as claimed in claim 8 wherein said first communication comprises:

a customer placing a telephone call to a data central operator and requesting a service order to said data central operator;

said data central operator receiving said service order by telephone and confirming said order and actuating entries into a specific mask in a data central program including allocating an order code to a personal identification number of said customer;

and wherein said second communication comprises:

switching said electronic postage meter machine into a communication mode by entering said personal identification number therein together with a reloading amount;

conducting a plausibility check at said data central by checking said personal identification number and selected register values of said electronic postage meter machine at said data central;

establishing communication between said data central and a credit card processing center for verifying a credit status of said customer and exchanging information via a separate on-line connection between said data central and said credit card processing center including said credit card number, expiration date, credit value and customer name;

said credit card processing center checking whether said credit card number is valid;

receiving authorization of an accepted credit card status in said data central from said credit card processing center if a liquidity of said customer is acceptable and thereafter automatically entering the requested credit amount into a specific mask for credit card payment and storing said credit card payment;

if said credit card status of said customer was not verified at said credit card processing center, returning to a beginning of said second communication and repeating said second communication;

if said credit card status was accepted by said credit card processing center, communicating a list of information relating to successful credit inquiries;

said credit card processing center authorizing a transfer of funds from a bank of said customer; and transferring said funds to a bank of a nationally authorized postal carrier.

12. An apparatus for operating a data central for offering and performing selected services for responding to a customer service request, said apparatus comprising:

a host computer disposed at said data central, said host computer including a stored data bank and a program for a credit inquiry;

a programmable input/output means, coupled to said host computer, for conducting a communication via a communication link with a remote postage meter machine and for implementing a communication via a further communication link to at least one bank for payment of reloading of said postage meter machine with a credit;

said data bank having two subregisters respectively allocated to accounts of a user of said postage meter machine for conducting a transaction; and means for transferring a credit from a bank of said customer into a first bank account at an authorized second bank coupled to said data central and for maintaining a credit in said first subregister of said data central corresponding to a prepaid amount and for using said second subregister in said data central for credit transactions.

13. An apparatus as claimed in claim 12 wherein said data bank and said program are stored on a single hard disk in said host computer.

14. An apparatus as claimed in claim 12 wherein said data bank and said program are respectively stored on different hard disks at said host computer.

15. An apparatus as claimed in claim 12 wherein said data bank and said program comprise a first service unit in combination with said input/output means, said first service unit having a communication link with said postage meter machine and connected to at least one operator terminal, said data bank having a memory location reserved for register entries for offering and performing services corresponding to a customer request.

16. An apparatus as claimed in claim 15 comprising a second service unit consisting of a second input/output means connected to said host computer via a transmission line and coupled to a bank terminal for communicating with said bank terminal by transmitting information verifying a credit status of said customer.

17. An apparatus as claimed in claim 16 further comprising a printer connected to said host computer for printing a list of communications regarding successful credit inquiries.

* * * * *